US008697178B2

(12) United States Patent
Boué

(10) Patent No.: US 8,697,178 B2
(45) Date of Patent: Apr. 15, 2014

(54) METHOD AND APPARATUS FOR APPLYING A COATING TO A CABLE

(75) Inventor: Andreas Boué, Nieblum (DE)

(73) Assignee: Diagnose-und Ingenieurgesellschaft Dr. Boué, Aachen (DE)

( * ) Notice: Subject to any disclaimer, the term of this patent is extended or adjusted under 35 U.S.C. 154(b) by 347 days.

(21) Appl. No.: 13/218,961

(22) Filed: Aug. 26, 2011

(65) Prior Publication Data

US 2013/0052335 A1 Feb. 28, 2013

(51) Int. Cl.
*B05D 3/00* (2006.01)

(52) U.S. Cl.
USPC ..... 427/9; 427/8; 427/299; 427/401; 118/17; 118/208; 118/307; 118/694; 118/708; 118/712; 401/208; 401/219

(58) Field of Classification Search
USPC ..... 427/9, 299, 8, 401; 118/708, 208, 307, 118/694, 17; 401/208, 219
See application file for complete search history.

(56) References Cited

U.S. PATENT DOCUMENTS 4,638,761 A * 1/1987 Carrick ..... 118/694
2010/0173081 A1* 7/2010 Lundgren ..... 427/299

FOREIGN PATENT DOCUMENTS

DE 102008049942 * 4/2010

* cited by examiner

*Primary Examiner* — Joseph Miller, Jr.
*Assistant Examiner* — Nathan T Leong
(74) *Attorney, Agent, or Firm* — BainwoodHuang

(57) ABSTRACT

A method for applying a coating to a cable, the cable having a longitudinal direction, includes A) cleaning the surface of the cable, and B) applying coating to the cable by rotating a coating application means around the cable allowing the application of the coating. The steps are performed from a platform being moved along the cable in a movement direction by at least three wheels that are fastened in a force-locking manner to the cable. Step A) is performed in the movement direction before the wheels, and step B) is performed in the movement direction behind the wheels. The wheels are driven by a motor that can be controlled in such a manner that the platform can be positioned at predefined positions reproducibly.

6 Claims, 2 Drawing Sheets

METHOD AND APPARATUS FOR APPLYING A COATING TO A CABLE

BACKGROUND

Subject matter of the present invention is a method and an apparatus for applying a coating to a cable. The present invention in particular deals with the application of anti-corrosive coatings to cables and with the repair of coatings on cables. The term "cable" in this context is in particular understood as a supporting element used to support a structure, in particular a supporting element for supporting a cable bridge and the like. In particular, the term "cable" is used to characterize cable made from wire or bars. Cables or bars being used to carry tractive forces into structures as are e.g. used in cable bridges or suspension bridges have to be checked regularly to avoid a break of the cables or bars originating in corrosion or damages. To avoid corrosion in the cables or bars the cables or bars (in the following: cables) are usually covered by a coating having anti corrosive pcablerties. If it is found that the coating is damaged or has fissures, holes or the like it is necessary to repair or substitute the coating. Until now such works on cables or bars in cable bridges or suspension bridges have been performed by human work force from manned platforms hanging in the air close to the cable or bar. This is a complex and potentially dangerous task being quite expensive for the owner of the respective bridge.

SUMMARY

The present disclosure is directed to a technique to overcome drawbacks of the prior art at least in part and which in particular allows to provide, repair or replace a coating of a cable or bar of e.g. a cable bridge or a suspension bridge in place in an unmanned fashion.

A disclosed method for applying a coating to a cable, the cable having a longitudinal direction, includes the following steps:

A) cleaning the surface of the cable;

B) applying the coating to the cable by rotating at least one coating application means around the cable allowing the application of the coating by the coating application means.

The above-mentioned steps are performed from a platform, the platform being moved along the cable in a movement direction by at least three wheels, the wheels being fastened in a force-locking manner to the cable, wherein step A) is performed in the movement direction before the wheels, wherein step B) is performed in the movement direction behind the wheels, wherein the wheels are driven by at least one motor, wherein the at least one motor can be controlled in such a manner that the platform can be positioned at predefined positions reproducibly.

The method according to present invention is therefore directed to the application of a coating by an automatically driven unmanned platform from which the cable can be cleaned by cleaning means and, consecutively, a new coating can be applied. It is to be understood that this coating can be a completely new coating or can be a coating covering fissures, holes or the like in the old existing coating of the cable. It has to be understood that the term cable does not only include usual metallic cables but bars as well. The coating can in particular be an anti-corrosive coating, e.g. in the form of a respective paint. Both single- and multi-component anti-corrosion protection coatings can be used in the inventive method and apparatus.

The wheels are preferably made from or covered with an elastomer to avoid damaging the cable while driving the platform above the cable. Preferably, the motor includes a controllable electric motor having a position encoder which allows to position the platform reproducibly on predetermined positions. By this it is e.g. possible to inspect the cable by a respective platform to analyze the damages of the coating and to specifically repair the respective damages of the coating in a subsequent step.

By this inventive method it is possible to repair a coating of a cable in situ meaning at the bridge without having to provide a large and complex platform for a manual repair including a housing and the like to be able to move workers to the respective positions. The application by coating application means like a usual paint brush which is moved in such a way that the bristles of the paint brush as coating application means are moved around the cable and are constantly in contact with the surface of the cable or the use of rollers as coating application means is preferred. It was found that it is easily possible to provide an annular ring around the cable to which several paint brushes are mounted such that the bristles of the brushes are directed to the cable and are touching the cable. It is possible to combine paint brushes and rollers in the coating application means. When the ring is rotated around the cable the coating is distributed around the cable and forms a film of coating on top of the surface of the cable. The coating is deposited within the coating application means or before the coating application means by a coating applicator like e.g. a tube or a nozzle. Single component and double component coatings can be applied in such a manner. The mixing of the two components forming the double component coating can be performed before the coating is loaded to the platform into a respective reservoir. Alternatively, it is possible to mix the two components directly on the platform while the platform moves.

According to an improvement of the present invention step A) includes the application of a cleaning fluid and the method further includes a step C) drying the surface of the cable, wherein the step C) is performed between step A) and step B).

This drying step can be performed by e.g. applying a stream of air to the cable or by bringing the surface of the cable in contact with a sucking element, e.g. a textile element. Furthermore, it is possible to perform the drying step by moving at least one wiper blade along the cable.

The drying step can improve the conditions for the application of the coating in the case of coatings which shall be applied on a dry substrate. Depending on the pcablerties of the coating this can improve the durability of the coating significantly.

According to a further improvement of the present invention step A) includes at least one of the following measures:

a) application of a cleaning fluid to at least a part of the surface of the cable and b) brushing at least a part of the surface of the cable.

As a cleaning fluid e.g. a solution of tensides or surfactants in water can be used. Step b) is preferably performed by a cleaning brush having hard bristles like metallic bristles. It is advantageous to combine measures a) and b) with step C).

According to a further improvement of the present invention the rotation frequency of the rotation of the at least one coating application means is at least as large as the ratio of the movement velocity of the platform to the perimeter of the cable.

This allows a particular good quality of the coating provided by the inventive method.

According to a further improvement at least the surface of the cable is inspected by at least one inspection means being mounted on the platform.

Preferably, the inspection includes at least one of the following inspections steps:

I) a visual inspection of the surface of the cable;

II) an ultrasonic inspection of at least the coating of the cable;

III) a film thickness measurement of the coating;

IV) a measurement of the hardness of the coating;

V) vibration measurements; and

VI) a magnetic field detection.

A magnetic field detection according to VI) is to be understood as the measurement of magnetic fields induced in the cable. A visual inspection can be performed by the collection of data using at least one image recording device like e.g. a camera. Vibration measurements can be understood as the recording of vibration modes in particular by using inertia sensors. The film thickness measurement can be performed in particular using magnetic methods or eddy current methods. An ultrasonic inspection can be performed by introducing an ultrasonic signal into the surface of the cable and recording the reflections of these ultrasonic signals at border layers. Therefore, failures of these layers can be detected. The hardness of the coating can be detected e.g. by a respective probe acting with a predetermined force of a predetermined area of the coating by measuring the respective resistance to distortion or deformation. This can particularly advantageous be performed at old coatings before repair or possible removal.

The data gathered by at least one of these inspection steps is collected and can be used to control the whole inventive method by e.g. directing the platform to respective damages or fissures, by reducing the velocity of movement to increase the thickness of the coating applied to the cable or the like. Furthermore, the data can be stored for documentation means. The inspection of the respective coating can in the case of a method in which the coating is controlled and repaired or partly replaced be performed at the old coating before the repair step and/or at the coating applied by the inventive method.

According to a further aspect of the present invention an apparatus for applying a coating to a cable having a longitudinal direction is provided, the apparatus including a platform being connectable to the cable in a force-locking manner using at least three wheels which can be positioned around the cable in a circumferential direction;

cleaning means being attached to the platform;

at least one coating application means being attached to the platform.

The at least one coating application means is being mounted rotatably around the position of the cable to allow the movement of the coating application means around the cable in contact with a surface of the cable, wherein the cleaning means are positioned on a first side of the wheels with respect to the longitudinal direction and the at least one coating application means being positioned on a second side of the wheels being opposite to the first side with respect to the longitudinal direction.

The term platform describes a carrier which is connected via the wheels in a force-locking manner to the cable in use. The platform can have any desired and suitable shape. The cleaning means are means that allow to clean the cable in use. The cleaning means can in particular includes at least one of the following elements:

i) at least one cleaning brush and ii) at least one cleaning fluid applicator.

Therefore, it is possible to clean the cable by brushing the cable and/or by applying a cleaning fluid like e.g. a solution of surfactants in water. It is possible to further include drying means by which the cable can be cleaned after the application of cleaning fluid.

Preferably the motor allows the control of the motion of the wheels in such a way that it is possible to position the platform at predetermined positions of the cable reproducibly. This means that even if the cable is quite long (lengths of several hundred meters or of one kilometer and more are possible in large suspension bridges) it is possible to position the platform at predetermined positions with an accuracy of less than a centimeter. The positioning of the cleaning means on a first side of the wheels and the at least one coating application means on the second side being opposite to the first side of the wheels means that in use the cable can first be cleaned by the cleaning means, wherein the cleaned part of the surface is subsequently rolled over by the wheels and again subsequently the coating can be applied by the coating application means. The coating application means include preferably at least one paint brush with bristles. Preferably, the at least one paint brush is mounted such that it is possible to rotate the at least one brush around the cable in use in such a way that the bristles of the paint brush touch the surface of the cable for the whole of the rotation movement around the cable.

The at least one cleaning fluid applicator can be a nozzle or a simple tube by which the cleaning fluid can be applied on the surface of the cable in use.

According to a further improvement of the present invention the cleaning means further include at least one cleaning fluid applicator, the apparatus further including drying means being positioned between the cleaning means and the at least one brush.

By the drying means it is possible to dry the cleaned surface of the cable at least partly. The drying means include preferably a fan by which air can be blown hot or cold onto the cable and/or sucking means by which the humidity on the surface of the cable can be sucked up. Sucking means can e.g. be textile elements or the like or elements being able to extract the humidity by capillary forces.

According to a further improvement the cleaning means include at least one cleaning brush, the cleaning brush including filaments made from metal.

As many of the cables used as elements in suspension bridges are made from metal a metallic cleaning brush can be used advantageously to clean the surface of the cable without damaging the same. In particular it is possible to remove parts of the old coating from the cable if these do not adhere completely to the surface of the cable any longer. This can e.g. be the case if due to a small fissure in the coating water enters the space between the coating and the cable and the beginning corrosion of the metallic cable leads to a partly disconnection of the coating form the cable.

According to a further improvement the coating application means include at least one of the following elements:

at least one paint brush and at least one roller.

The roller can be a synthetic roller having a porous structure.

According to a further improvement the coating application means include at least one paint brush with at least one of the following elements:

Φ) at least one natural bristle and

Δ) at least one synthetic bristle.

The term synthetic bristle covers a bristle made from plastic or plastic material. It is to be understood that a synthetic bristle does not include a metallic bristle. Natural bristles cover in particular bristles of pigs, goats, and the like.

According to a further improvement the apparatus according to the present invention further includes at least one inspection means.

Preferably, the inspection means include at least one of the following elements:

α) visual inspection means;

β) ultrasonic inspection means;

χ) film thickness measurement means;

δ) hardness measurement means;

ϵ) vibration measurement means;

ϕ) magnetic field detection means.

In particular, the visual inspection means are designed to allow the visual inspection according to step I) above. The ultrasonic inspection means are in particular designed to perform an ultrasonic inspection of at least the coating of the cable as defined in step II) above. The film thickness measurement means are in particular designed to perform a film thickness measurement of the coating according to III). The hardness measurement means are in particular designed to allow the performance of the measurement of the hardness of the coating according to step IV) above. The vibration measurement means are in particular designed to allow vibration measurements as defined in step V) above. The magnetic field detection means are in particular designed to allow a magnetic field detection as discussed regarding step VI) above. Reference is made to the details disclosed above regarding these steps II) to VI).

The details and advantages disclosed for the method according to the present invention are transferable to the apparatus according to the present invention and vice versa.

BRIEF DESCRIPTION OF THE DRAWING

Two embodiments of the present invention will now be described in detail by way of example only with reference to the accompanying drawings in which the following is depicted schematically.

DETAILED DESCRIPTION

Figure 1:
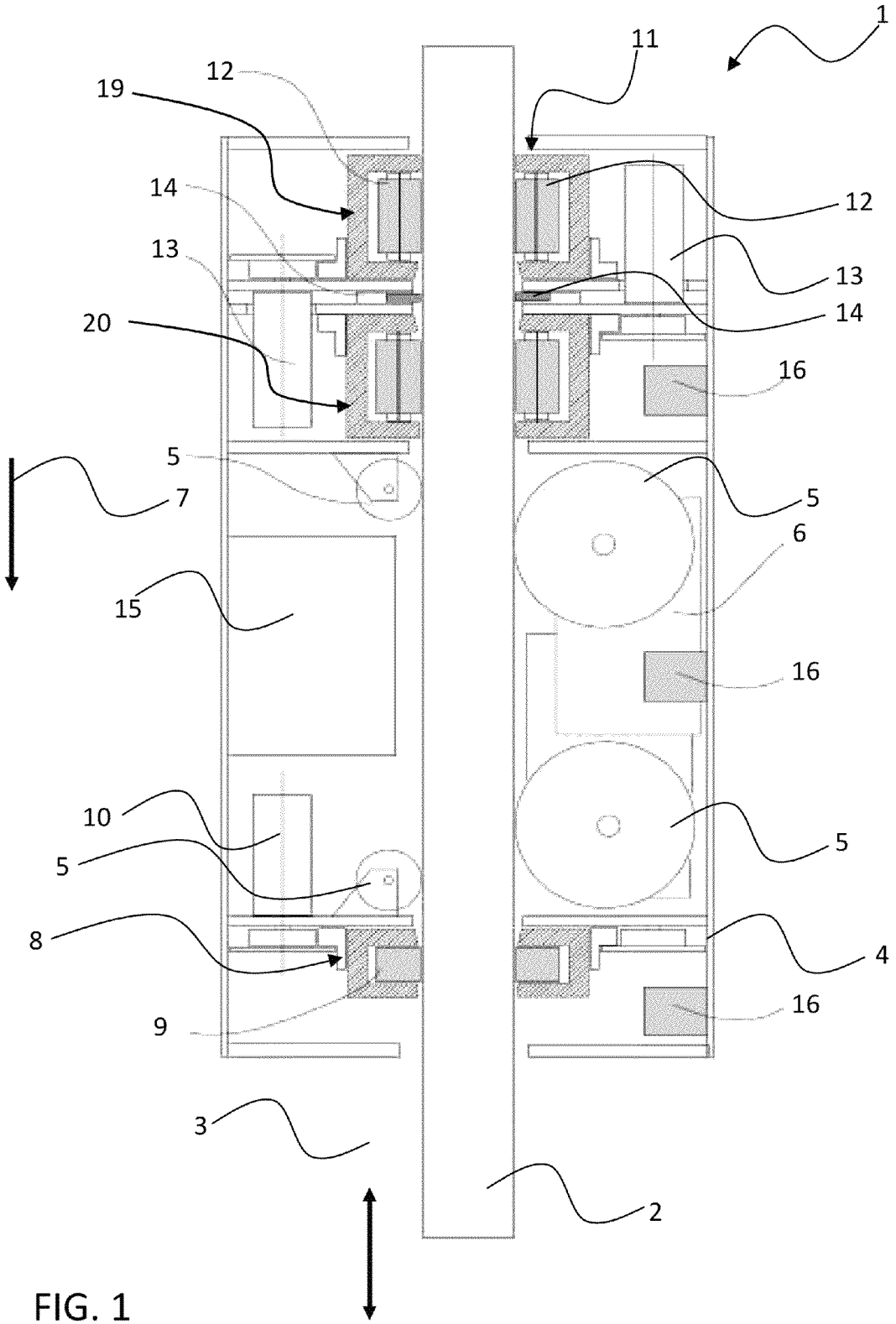
FIG. 1 a first embodiment of an apparatus according to the present invention.

FIG. 1 displays schematically an apparatus 1 for applying a coating to a cable 2 having a longitudinal direction 3. The cable 2 is a cable of a suspension bridge or a hanging bridge (not displayed). The apparatus 1 includes a platform 4. The term platform 4 is to be understood as a carrier for further equipment. The platform 4 is connected to the cable 2 in a force-locking manner using the wheels 5. The apparatus 1 includes six wheels 5, only a part of which are displayed in the figure. The wheels 5 are distributed around the cable in a circumferential direction to allow a safe connection between the apparatus 1 and the cable 2 without damaging the surface of the cable 2. A part of the wheels 5 can be driven by a motor 6. By rotating the wheels 5 the platform 4 and the apparatus 1 is moved on the cable 2. In use the apparatus 1 is moved in a movement direction 7. Preferably, the apparatus 1 is in use moved in a movement direction 7 being oriented preferably from top to down. This means that liquid applied to the cable 2 is driven by gravitational forces in the movement direction 7 of the apparatus 1.

The apparatus 1 further includes cleaning means 8. These cleaning means 8 include rotating cleaning brushes 9. These cleaning brushes 9 include bristles made from metal wire. The cleaning means 8 further include cleaning brush driving units 10. These cleaning brush driving units 10 allow to rotate the cleaning brush 9 at least around the cable 2 in a circumferential direction. According to a preferred embodiment the cleaning brush driving units 10 are adapted to perform a simultaneous rotation of the cleaning brush 9 around a further axis e.g. perpendicular to the cable 2 surface. The embodiments displayed in the figures include four cleaning brushes 9. The cleaning means 8 can be used to clean the cable 2 from debris having agglomerated on the surface of the cable 2. The cleaning means 8 can be used as well to remove at least a part of an old coating on the cable 2.

The apparatus 1 further includes at least one coating application means 11. In the present embodiment each coating application means 11 include several rollers 12 forming an upper roller group 19 and a lower roller group 20. The coating application means 11 can be rotated around the cable 2. In use and during the rotation of the coating application means 11 around the cable 2 the rollers 12 roll on the surface of the cable 2. Alternatively, as shown in the embodiment in FIG. 2, the coating application means 11 can include paint brushes. The coating application means 11 further include a coating application means driving unit 13 by which the coating application means 11 are rotated around the cable 2. Additionally, the rollers 12 can be rotated themselves independently from the movement of the whole coating application means 11.

The coating application means 11 include two coating applicators 14 as well positioned in movement direction 7 between the upper roller group 19 and the lower roller group 20. These coating applicators 14 are in this embodiment small tubes through which the coating is applied on the surface of the cable 2. The two coating applicators 14 in this embodiment are positioned on opposite sides of the cable 2. The coating applicators 14 are connected with a coating storage unit 15 which includes a reservoir and a pump to pump the coating from the coating storage unit 15 to the coating applicators 14 via tubes (not displayed in this figure).

In use the coating is applied through the coating applicators 14 in between the rollers 12. In movement direction 7 of the apparatus 1 the coating is applied in between the rollers 12. The coating is applied as droplets by the coating applicators 14. Primarily, the coating is distributed around and applied to the cable 2 by the upper roller group 19. Nevertheless, due to gravity it is possible depending on the viscosity of the coating that at least a part of the coating will flow downwards in movement direction 7. In this case the coating is distributed around the cable 2 by the lower roller group 20.

The cleaning means 8 and the coating application means 11 are positioned on opposite sides of the wheels 5. The apparatus 1 further includes visual inspection means 16. By these the surface of the cable 2 can be visually controlled. The visual inspection means 16 e.g. include cameras. As several visual inspection means 16 are embodied it is possible to control the pcabler functionality of the coating application means 11 and the cleaning means 8 separately.

The term coating covers coatings which are readily provided and coatings which have to be mixed from two separate components.

The apparatus 1 can be used for a documentation of the surface of the cable 2 by intensive use of the visual inspection means 16. Furthermore, it can be used for to clean a cable 2 and for to apply a coating to the cable 2.

Figure 2:
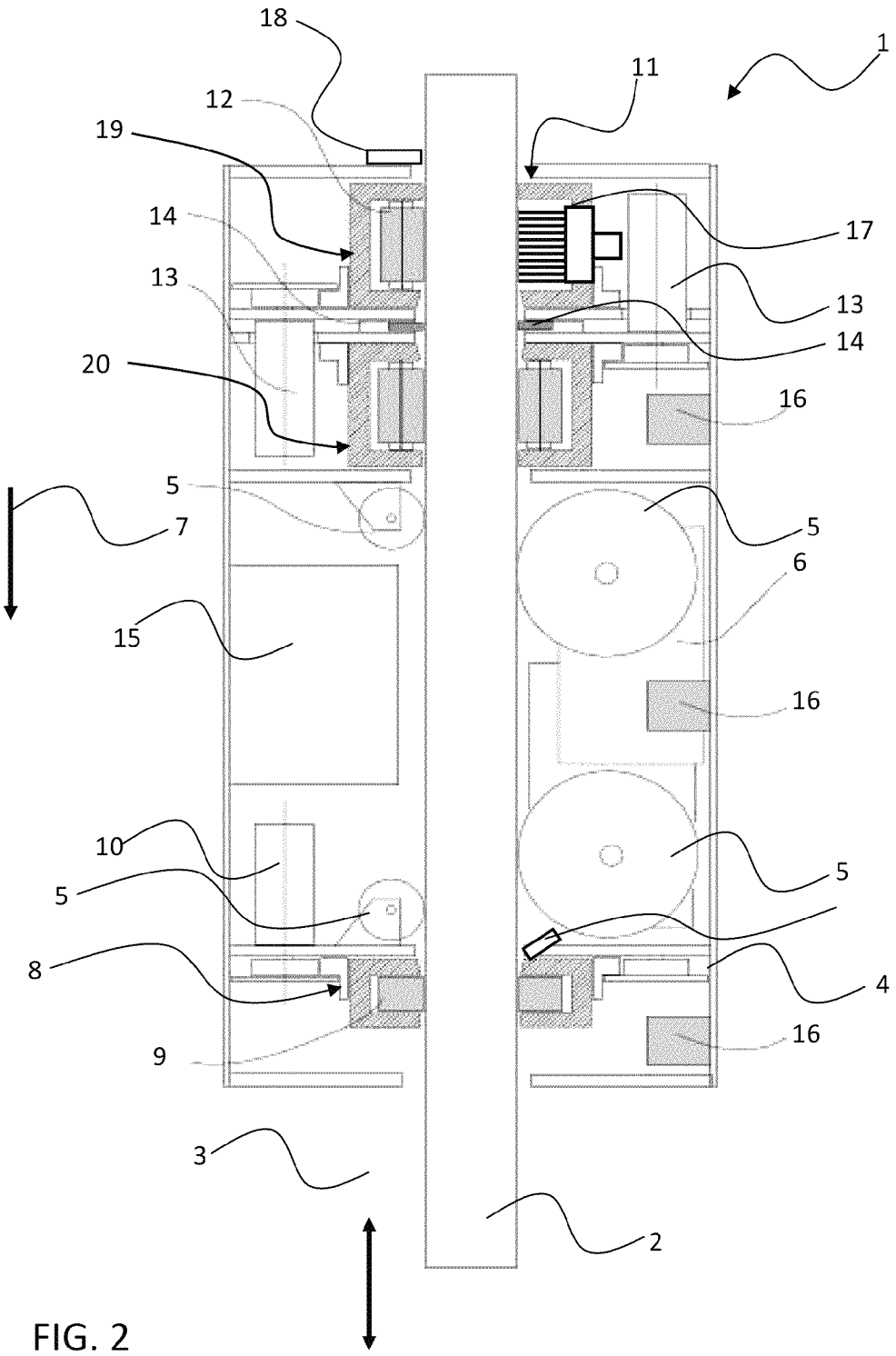
FIG. 2 a second embodiment of an apparatus according to the present invention.

FIG. 2 displays a second embodiment of the apparatus 1 according to the present invention. Only the differences to the first embodiment are described here. The second embodiment of the apparatus 1 includes instead of the roller 12 paint brushes 17. These paint brushes 17 are made from natural and/or synthetic bristles. The brushes are mounted such that the bristles touch the cable 2 in use. The paint brushes 17 can be rotated around the cable 2 so that the bristles of the paint brushes 17 are constantly in contact with the surface of the cable 2. By application of the coating via the coating applicator 14 the coating can be distributed around the cable 2 to form a coating of constant film thickness.

Furthermore, the second embodiment of the apparatus 1 includes film thickness measurement means 18 to control the thickness of the coating applied by using the apparatus 1 after the application. The data from the film thickness measurement means 18 and the visual inspection means 16 can be used to control the cleaning means 8, the coating application means 11 and the movement velocity of the whole apparatus 1.

The data of the visual inspection means 16 and the film thickness measurement means 18 and of other inspection means not displayed in the embodiments here can be transferred to a central processing unit mounted on the apparatus 1 or being disposed outside the apparatus 1 by use of a wire or wireless.

The method and the apparatus according to the present invention allow the application of a coating on a cable in particular on a cable being used in a suspension bridge or a hanging bridge automatically in situ without the need for demounting the cable or providing a manned platform. By use of the cleaning means 8 and the coating application means 11 it is possible to remove parts of old coatings and apply new coatings or to apply a completely new (first) coating on a new cable 2.

List of Reference Numbers

1 apparatus for applying a coating to a cable
2 cable
3 longitudinal direction
4 platform
5 wheel
6 motor
7 movement direction
8 cleaning means
9 cleaning brush
10 cleaning brush driving unit
11 coating application means
12 roller
13 coating application means driving unit
14 coating applicator
15 coating storage unit
16 visual inspection means
17 paint brush
18 film thickness measurement means
19 upper roller group
20 lower roller group

What is claimed is:

1. A method for applying a coating to a cable, said cable having a longitudinal direction, said method comprising the following steps:

A) cleaning the surface of said cable;

B) applying said coating to said cable by rotating at least one coating application means around the cable allowing the application of said coating by the coating application means;

wherein the above-mentioned steps are performed from a platform, said platform being moved along said cable in a movement direction by at least three wheels, said wheels being fastened in a force-locking manner to the cable, wherein step A) is performed in the movement direction before the wheels, wherein step B) is performed in the movement direction behind the wheels, wherein said wheels are driven by at least one motor, wherein said at least one motor can be controlled in such a manner that said platform can be positioned at predefined positions reproducibly.

2. A method according to claim 1, wherein step A) comprises the application of a cleaning fluid and the method further comprises a step C) drying said surface of said cable, wherein said step C) is performed between step A) and step B).

3. A method according to claim 1, wherein step A) comprises at least one of the following measures:

a) application of a cleaning fluid to at least a part of said surface of said cable and b) brushing at least a part of said surface of said cable.

4. A method according to claim 1, wherein the rotation frequency of the rotation of said at least one coating application means is at least as large as the ratio of the movement velocity of said platform to the perimeter of the cable.

5. A method according to claim 1, wherein at least said surface of said cable is inspected by at least one inspection means being mounted on the platform.

6. A method according to claim 5, wherein said inspection comprises at least one of the following inspection steps:

I) a visual inspection of said surface of said cable;

II) an ultrasonic inspection of at least said coating of said cable;

III) a film thickness measurement of the coating;

IV) a measurement of the hardness of the coating;

V) vibration measurements; and

VI) a magnetic field detection.

* * * * *